US005379615A

United States Patent [19]

Shima

[11] Patent Number: 5,379,615

[45] Date of Patent: Jan. 10, 1995

[54] TUBULAR KNIT FABRIC HAVING VENT PORTION

[75] Inventor: Masahiro Shima, Wakayama, Japan

[73] Assignee: Shima Seiki Mfg. Ltd., Wakayama, Japan

[21] Appl. No.: 39,307

[22] PCT Filed: Oct. 11, 1991

[86] PCT No.: PCT/JP91/01387

§ 371 Date: Jun. 11, 1993

§ 102(e) Date: Jun. 11, 1993

[87] PCT Pub. No.: WO92/07128

PCT Pub. Date: Apr. 30, 1992

[30] Foreign Application Priority Data

Oct. 12, 1990 [JP] Japan ..... 2-275019

[51] Int. Cl.[6] ..... D04B 1/24

[52] U.S. Cl. ..... 66/176; 66/189; 66/69

[58] Field of Search ..... 66/172 R, 176, 189, 66/170, 171, 169, 69, 64

[56] References Cited

FOREIGN PATENT DOCUMENTS 0194154 10/1985 Japan .
2114170 8/1983 United Kingdom ..... 66/172 R
2140469 11/1984 United Kingdom ..... 66/172 R

OTHER PUBLICATIONS

Patent for Tubular Knit on V-Bed, Knitting International, Jun. 1992 p. 66.

*Primary Examiner*—Clifford D. Crowder
*Assistant Examiner*—John J. Calvert
*Attorney, Agent, or Firm*—Spensley Horn Jubas & Lubitz

[57] ABSTRACT

Knitting structure with a processed end portion of a vent portion provided at a knit fabric which is knit in a tubular configuration using a flat knitting machine. A knitting yarn is turned back at an intermediate portion of each course after a predetermined course among knitting course of a knit fabric to form the vent portion and loops constituted from the turned back knitting yarns which form the vent portion are racked by a suitable pitch in a next course at the vent portion.

4 Claims, 23 Drawing Sheets

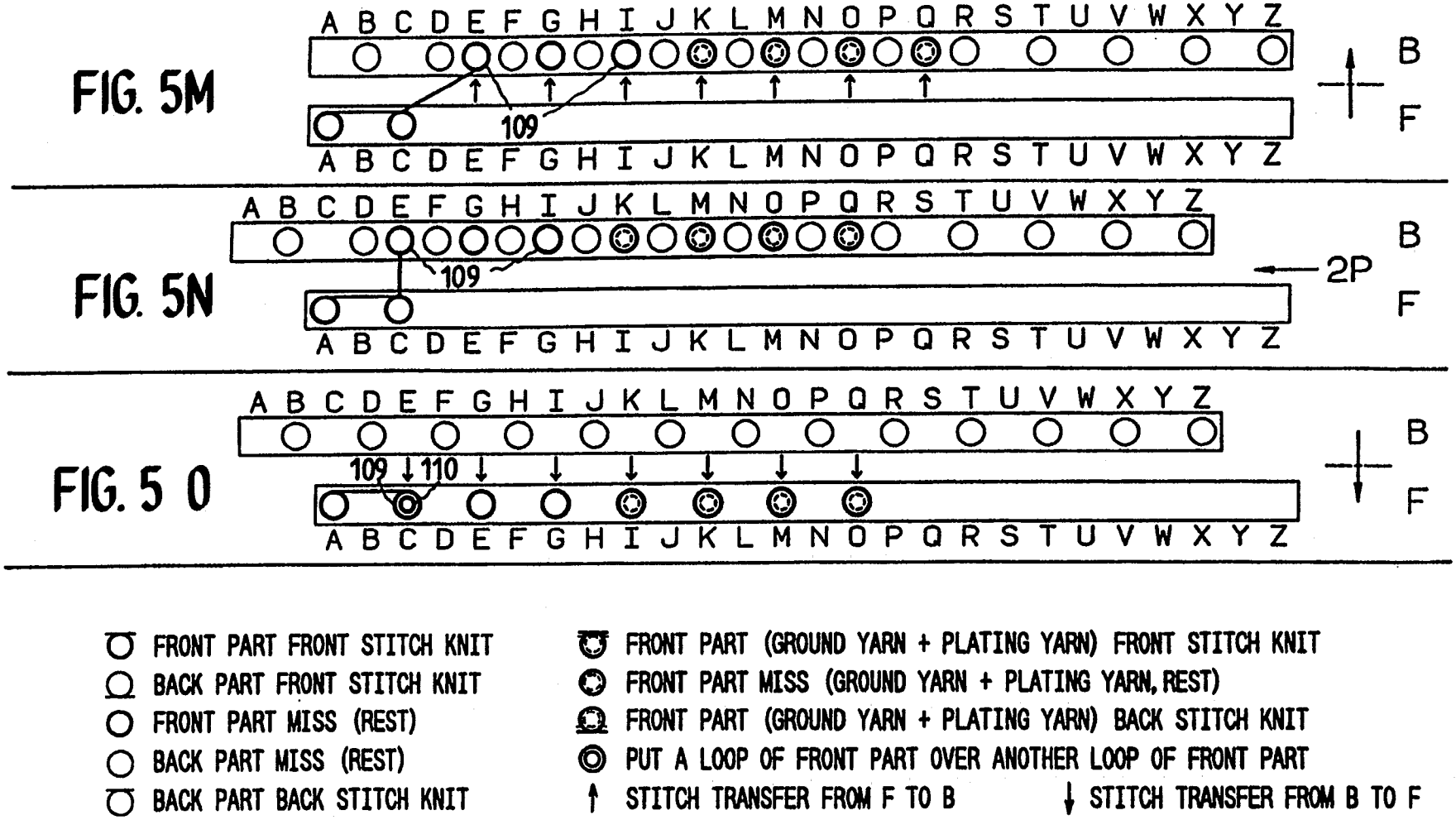
FIG. 5M
FIG. 5N
FIG. 5 O
A B C D E F G H I J K L M N O P Q R S T U V W X Y Z
B
F
2P
109
110
FRONT PART FRONT STITCH KNIT
BACK PART FRONT STITCH KNIT
FRONT PART MISS (REST)
BACK PART MISS (REST)
BACK PART BACK STITCH KNIT
FRONT PART (GROUND YARN + PLATING YARN) FRONT STITCH KNIT
FRONT PART MISS (GROUND YARN + PLATING YARN, REST)
FRONT PART (GROUND YARN + PLATING YARN) BACK STITCH KNIT
PUT A LOOP OF FRONT PART OVER ANOTHER LOOP OF FRONT PART
STITCH TRANSFER FROM F TO B
STITCH TRANSFER FROM B TO F

TUBULAR KNIT FABRIC HAVING VENT PORTION

TECHNICAL FIELD

This invention relates to a tubular knit fabric characterized in a knitting structure with a processed end portion of a vent portion provided at a knit fabric which is knit in a tubular configuration using a flat knitting machine, such as, for example, a neck line portion or an armhole portion of a vest.

BACKGROUND ART

When a garment such as a vest or a sweater is to be manufactured using a knit fabric, a fabric knit on a circular knitting machine or a flat knitting machine is cut into a suitable shape, and then, a pair of sleeves, a collar, a pair of bottoms and so forth are attached to the thus cut fabric by sewing, linking or the like. Meanwhile, even in the case of a vest or the like wherein a sleeve, a collar or the like is not attached, a knit fabric in the form of a tape separately knit is attached to an end edge of a vent portion such as an armhole or a neck line of such vest or the like to provide a selvage to the vest or the like. However, since those processing operations must be performed after knitting separately from such knitting operation, such a circumstance takes place that the cost is increased.

DISCLOSURE OF INVENTION

It is an object of the present invention to obtain a tubular knit fabric wherein, in view of such regards as described above, processing of an end edge of a vent portion of an armhole, a neck line or the like of a tubular knit fabric for use for a vest, a sweeter or the like is completed in a process of knitting while reinforcement of the portion is performed simultaneously and as result, neither sewing operation nor reinforcing operation is required after knitting.

A tubular knit fabric of the present invention is constituted such that a knitting yarn is turned back at an intermediate portion of each course after a predetermined course among knitting courses of a knit fabric which is knit in a forwardly and rearwardly overlapping condition and a vent portion is provided at the position at which the knitting yarn is turned back such that it extends across the direction of a course. At the vent portion, loops constituted from the turned back knitting yarns which form the vent portion are racked by a suitable pitch in a next course so that the magnitude of the opening of the vent is gradually increased.

And, at suitable wales of an end edge portion of the knit fabric along the vent portion, a pattern is presented by suitably selecting a structure, or a plating yarn is supplied together with a ground yarn with which the portion is knit in order to reinforce the portion.

BRIEF DESCRIPTION OF DRAWINGS

FIG. 4 is a structural view of the second embodiment of a tubular knit fabric of the present invention in a condition wherein both front and back side knit fabrics are overlapped with each other; FIGS. 5A to 5O are knitting diagrams showing conditions of supply yarns and loops of a knit fabric suspended on needles of front and back needle beds in the order of steps when the knit fabric described above is to be knit;

BEST MODE FOR CARRYING OUT THE INVENTION

Figure 1:
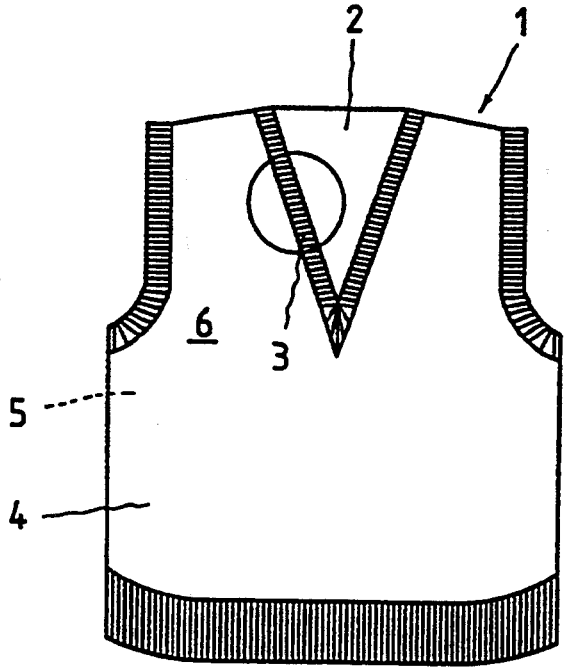
FIG. 1 is a front elevational view of a vest according to a knit fabric of the present invention.

An embodiment of a knit fabric of the present invention will be described subsequently.

Either of flat knitting machines having two beds and four beds can be employed as a knitting machine for knitting a knit fabric of the present invention.

A carriage of such knitting machine as described above has knitting locks and transfer locks, and upon movement of the carriage, loop transfer is performed by a transfer lock on the leading side and then knitting is performed by a knitting lock on the trailing side.

An example of knitting of a knit fabric end edge portion 3 forming a neck line portion 2 which is a vent portion provided on a vest 1 shown in FIG. 1 will be described subsequently.

A front part 4 of the vest 1 is knit on a front bed F (shown in FIGS. 3, 5 and 6) while a back part 5 of the vest 1 is knit on a back bed B (shown in FIGS. 3, 5 and 6) so that the vest 1 is knit into a tubular configuration as a whole. And, when upper portions of front shoulder portions 6 and the back part 5 are to be knit, the knitting width between both shoulders is reduced suitably while also the knitting width of the front shoulder portions are gradually reduced such that the knit fabric end edge portions 3 of the neck line portion 2 may be inclined in a V shape so that the upper portions may be opened in order to make the neck line portion 2.

And, the knit fabric end edge portions 3 are knit in a series together with the front shoulder portions 6 using same knitting yarn as that of the front shoulder portions 6.

Knitting of a knit fabric end edge portion 3 connecting to a front shoulder portion 6 will be described subsequently with reference to FIGS. 2 and 3.

Figure 2:
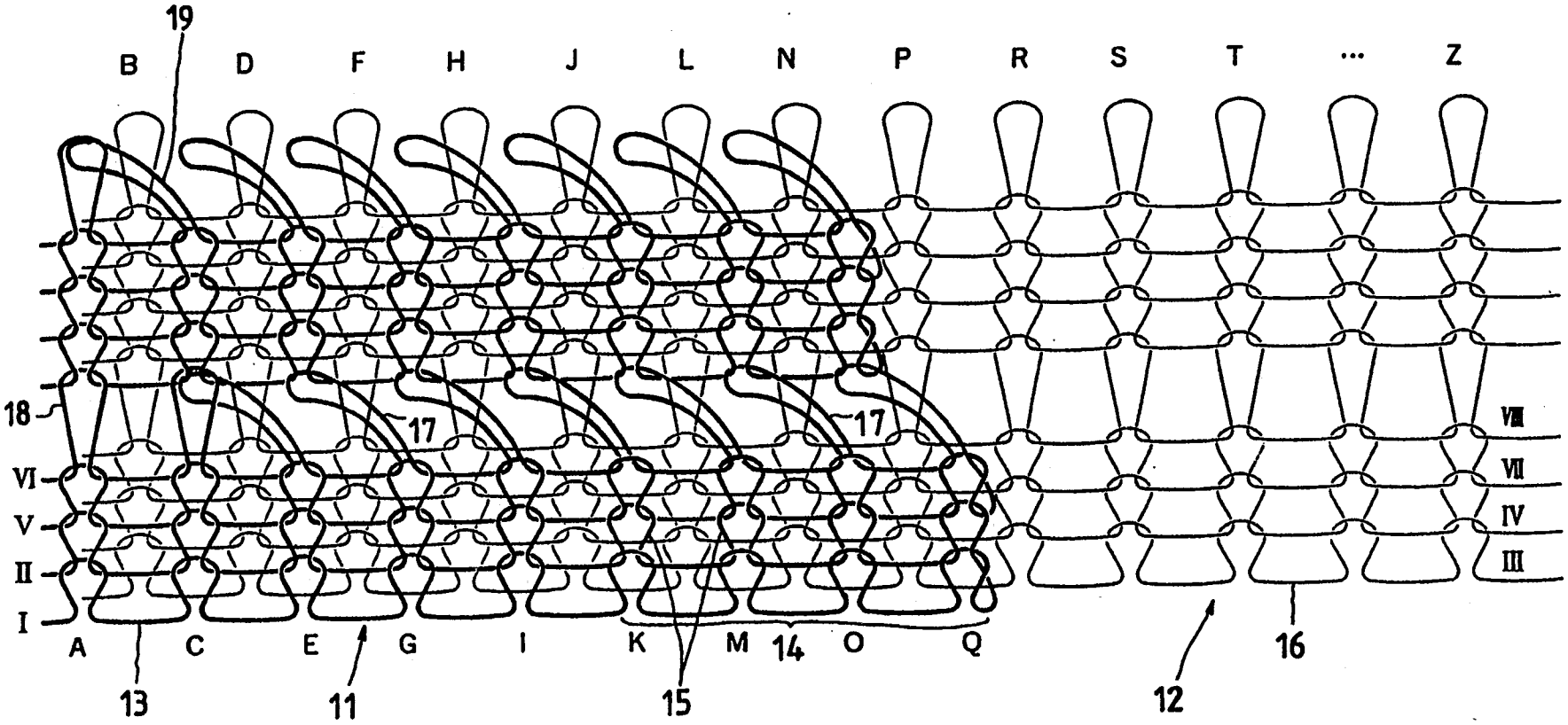
FIG. 2 is a structural view of a first embodiment of a tubular knit fabric of the present invention in a condition wherein both front and back side knit fabrics are overlapped with each other.

FIG. 2 is a structural view showing a knit fabric 11 (indicated by thick lines) of a front shoulder portion 6 and another knit fabric 12 (indicated by thin lines) of the back part 5 in an overlapping condition, and a process of knitting of the same will be described with reference to FIG. 3. However, description will be given only of the left-hand side of the garment (left-hand side front shoulder portion of the vest facing the same) for the convenience of description.

Figures 3A, 3B, 3C, 3D:
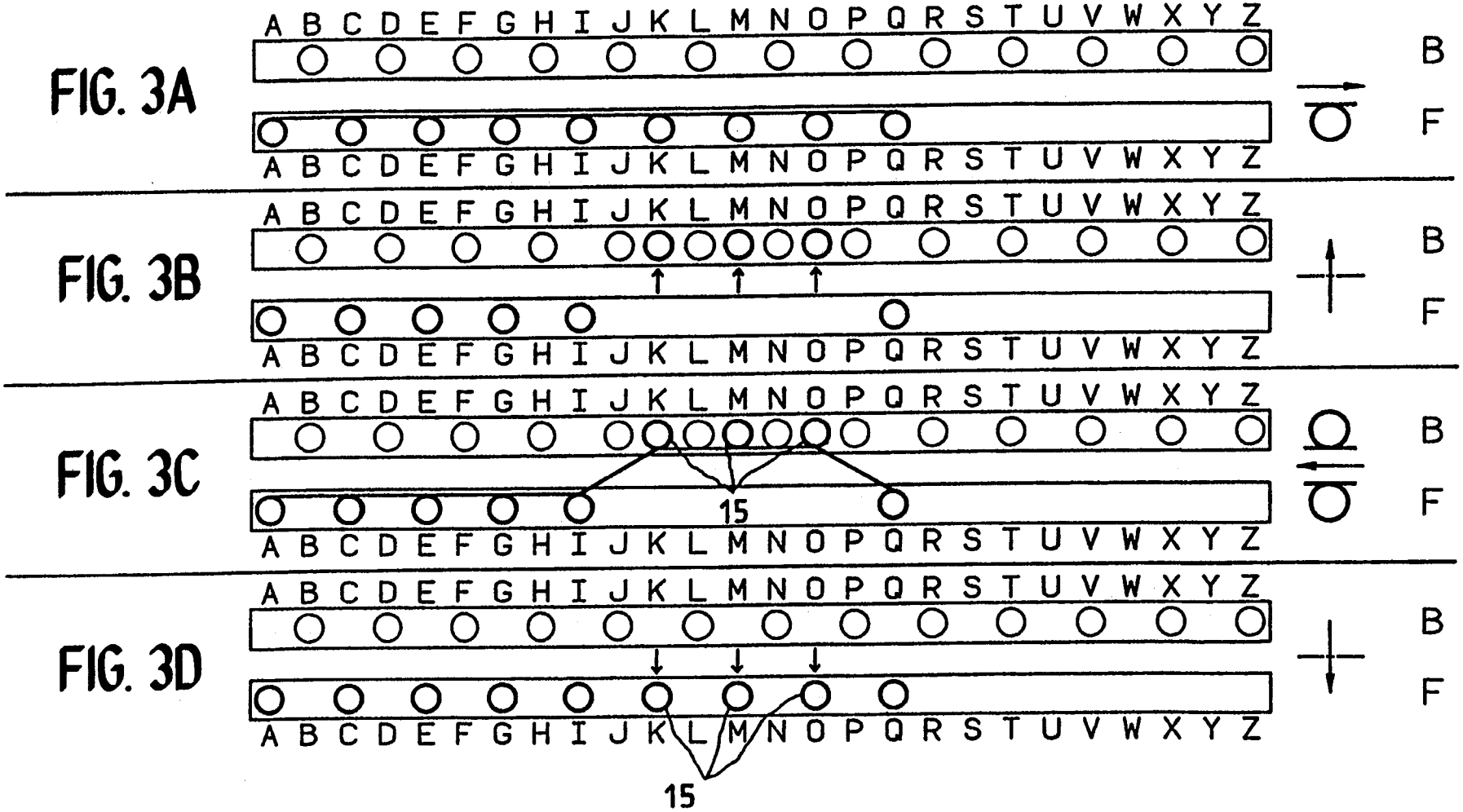
FIGS. 3A to 3O are knitting diagrams showing conditions of a supply yarn and loops of a knit fabric suspended on needles of front and back needle beds in the order of steps when the knit fabric described above is to be knit.
Figures 3E, 3F, 3G, 3H:
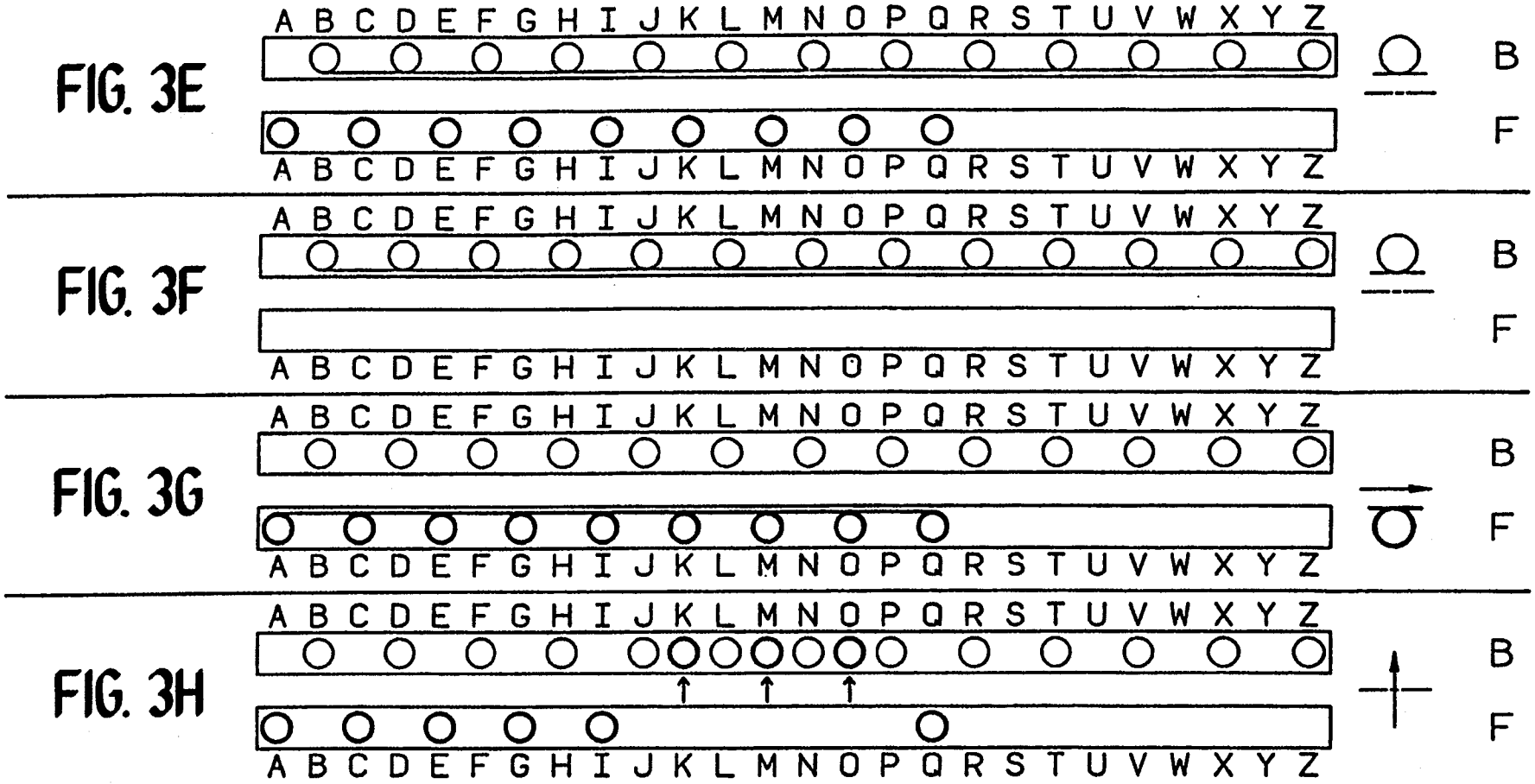
Figures 3I, 3J, 3K, 3L:
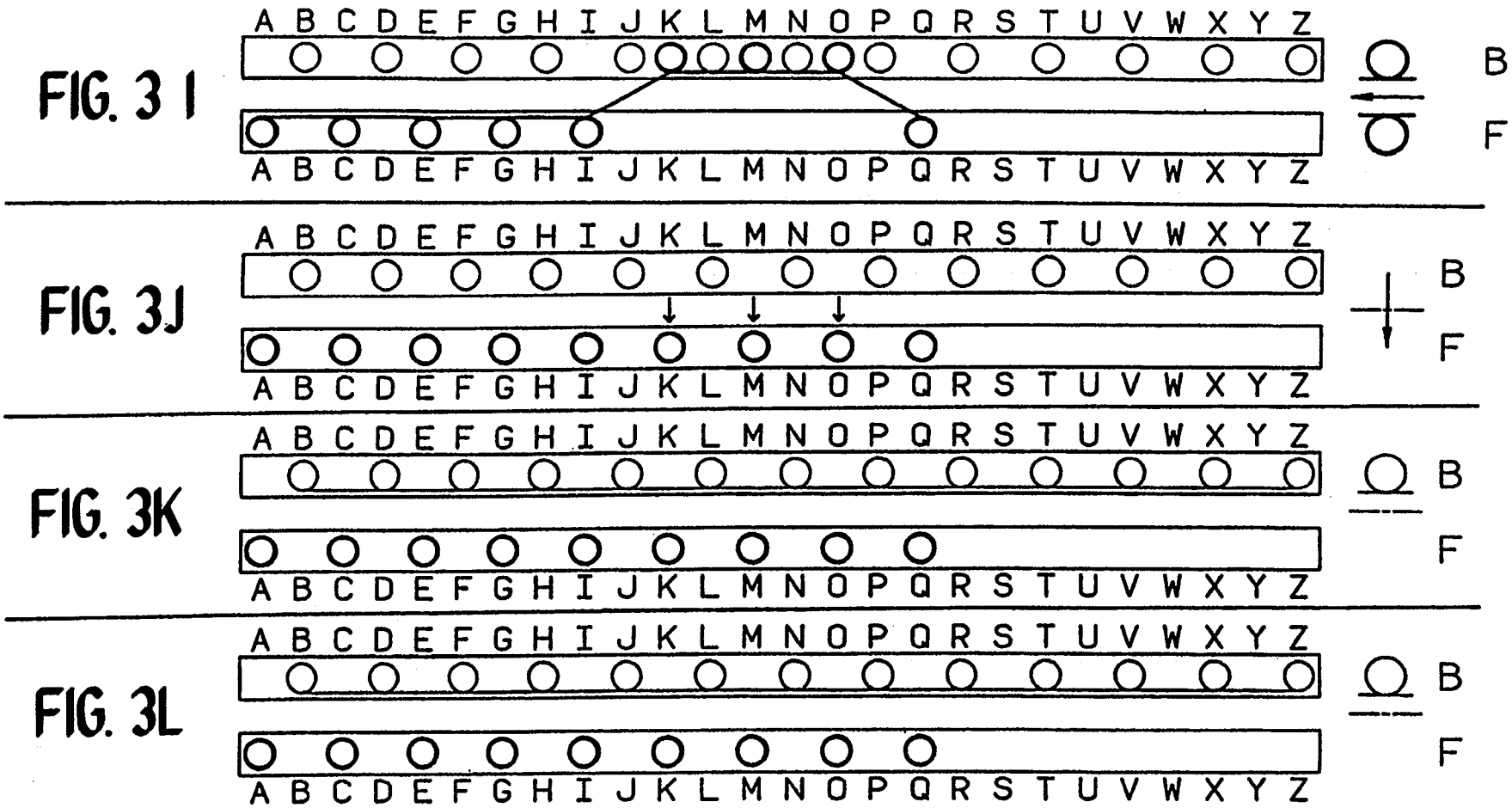

First, in a course I of the knit fabric (hereinafter referred to as front knit fabric) 11 of the left-hand side front shoulder portion 6, a knitting yarn 13 is supplied to every other needles A, C, . . . and Q of a front bed F, and is supplied and knit as shown in FIG. 3A. And, in order to knit a knit fabric end edge portion 3 (shown in FIG. 1) into a purl stitch 14 wherein a knit loop and a purl loop appear alternately in a direction of a wale, loops on the needles K, M and O of the front bed F are transferred to needles K, M and O of a back bed (FIG. 3B). And in a course II, a yarn is supplied to and knit by the needles Q, I, . . . , C and A of the front bed F and the needles 0, M and K of the back bed B (FIG. 3C). Consequently, knit loops are knit by the needles Q, I, . . . , C and A while purl loops are knit by the needles O, M and K. Subsequently, in order to knit the knit fabric (hereinafter referred to as back knit fabric) 12 of the back part 5, the loops 15 suspended on the needles K, M and 0 of the back bed B are transferred to the needles K, M and 0 of the front bed F (FIG. 3D), and then a knitting yarn 16 is supplied to B, D, . . . and Z of the back bed B to knit a course III (FIG. 3E). Then, also a succeeding course IV is knit similarly (FIG. 3F).

Subsequently, advancing to knitting of the front knit fabric 11 again, a yarn is supplied similarly as described above to knit courses V and VI (FIGS. 36 to 3J), and then knitting of courses VII and VIII of the back knit fabric 12 (FIGS. 3K and 3L) is performed.

After completion of such knitting as described above, the position of the knit fabric end edge portion 3 must be displaced to the left in order to open an upper portion of the neck line portion 2 into a V shape. To this end, the knitting width of the front knit fabric 11 is to be reduced.

Figures 3M, 3N, 3O:
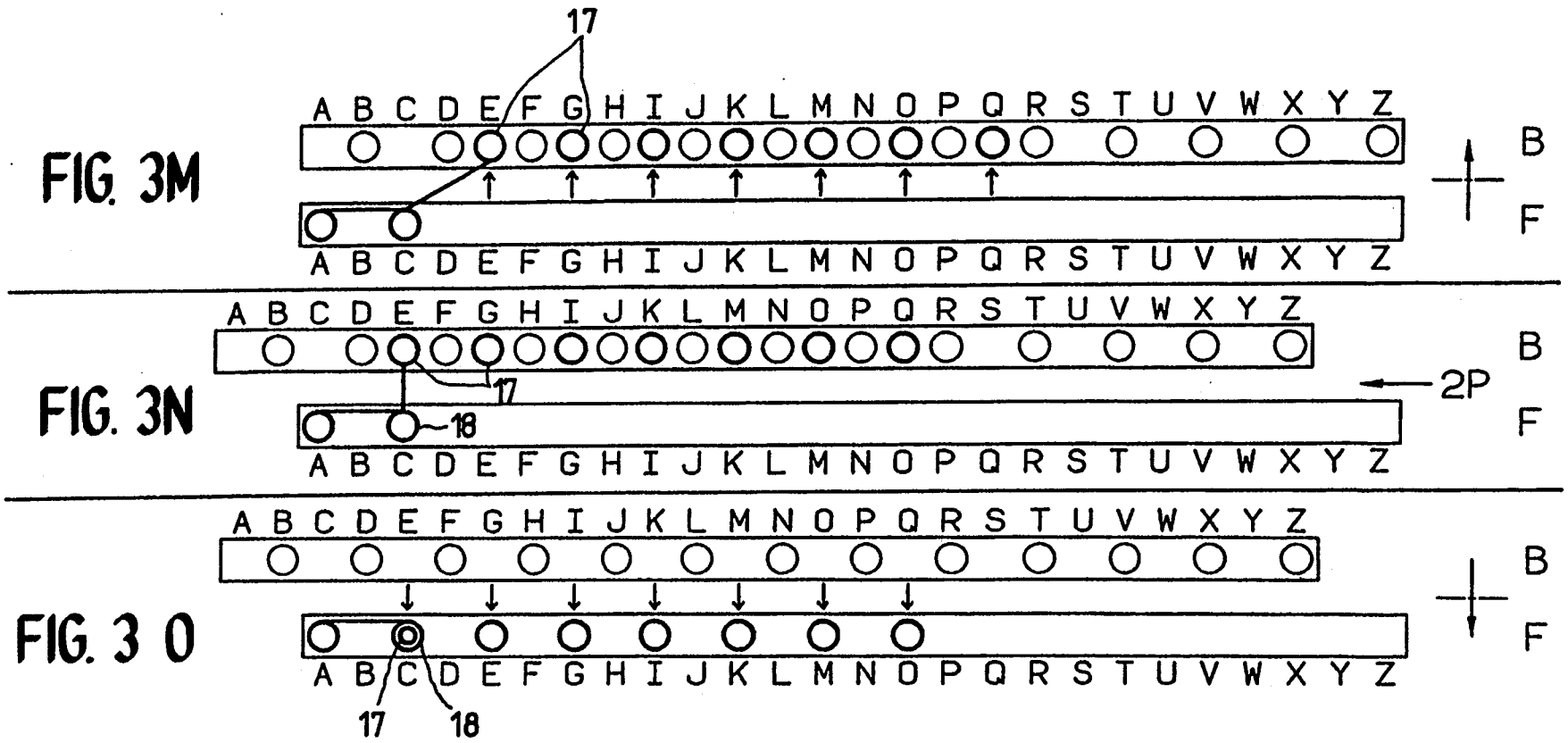

First, loops on the needles E, G, . . . and Q of the front bed F of the course VI of the front knit fabric 11 are transferred to the needles E, G, . . . and Q of the back bed B (FIG. 3M). Then, the back bed B is racked by a distance equal to two needle distances in the leftward direction so that the needles A, B, . . . and X of the front bed F and the needles C, D, E, . . . and Z of the back bed B are opposed to each other (FIG. 3N). Then, the loops having been transferred to the needles E, G, . . . and Q of the back bed B of the course VI are transferred back to the needles C, E, . . . and O of the front bed F. Consequently, the loops which were on the needles E, G, . . . and Q of the front bed F of the front knit fabric 11 are moved to the adjacent needles C, E, . . . and O of the same front bed F leftwardly by the two needle distances such that the loop 17 which was on the needle E is overlapped with the loop 18 on the needle C (FIG. 3O).

After such loop transfer, knitting returns to FIG. 3A and is repeated, and each time racking is performed, loops are displaced so that the neck line portion 2 is widened.

According to such knitting as described above, at the knit fabric end edge portion 3 along the neck line portion 2, a purl stitch portion 14 is formed over four wales, and a fashion mark 19 of knit loops by racking appears over three wales on the inner side of the four wales and constitutes a profile of the knit fabric end edge portion 3 of the neck line portion 2.

In the embodiment described so far, front and back parts and a collar are knit continuously using a same yarn and the collar is produced at an end edge portion by changing the structure. However, plating is sometimes performed only for an end portion in order to maintain a further strength at a collar portion, to provide a sufficient thickness to a knit fabric, to provide a stiffness, to provide a tension and so forth. Further, it is also possible to knit only an end portion in an intersia stitch.

Subsequently, another embodiment wherein plating is applied to such a vest as shown in FIG. 1 similar to that described hereinabove will be described.

Figure 4:
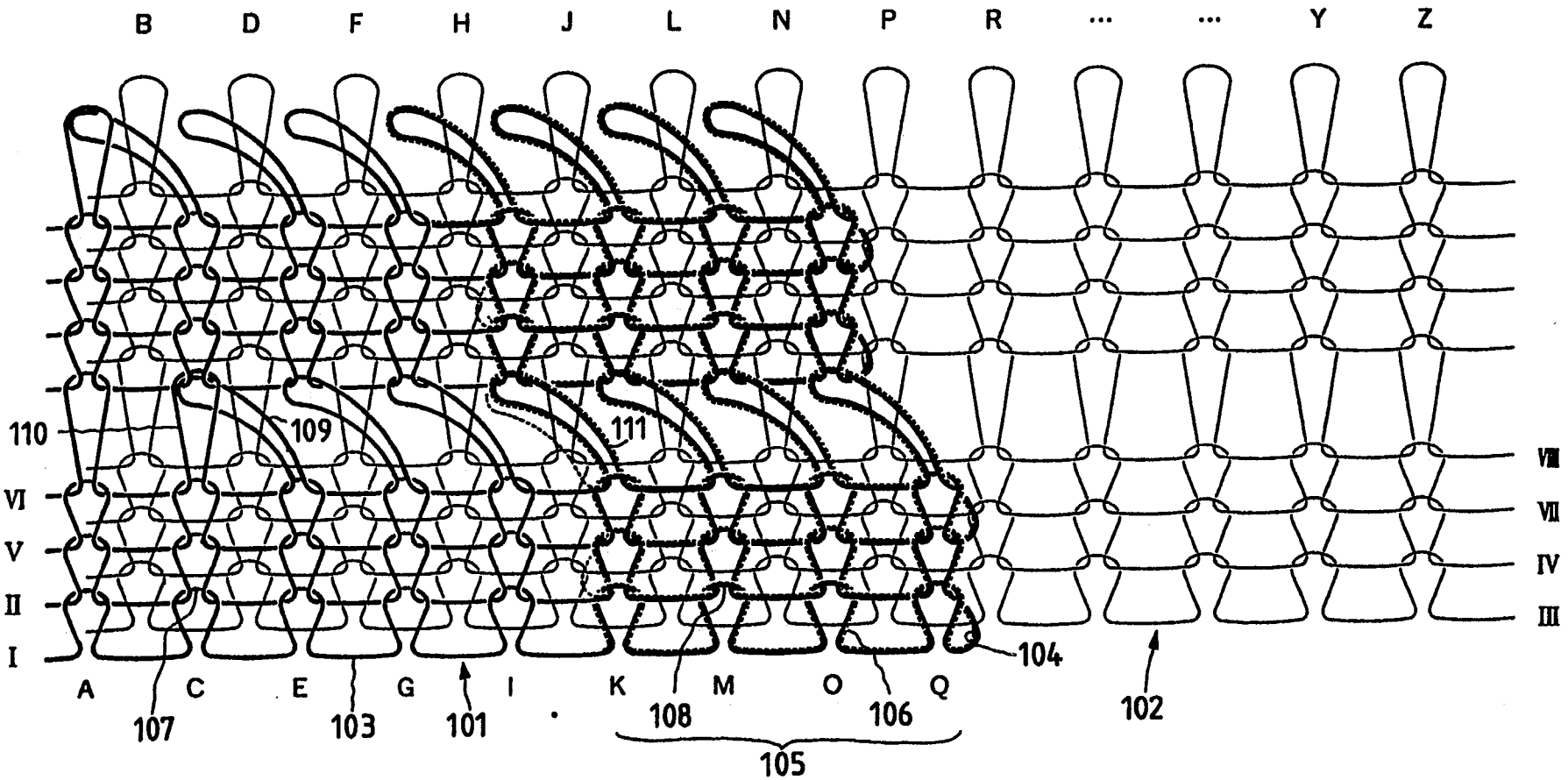
FIGS. 4 and 5A to 5O show a second embodiment wherein plating is performed only for an end portion.

FIG. 4 is a structural view wherein a knit fabric 101 (indicated by thick lines) of a front shoulder portion 6 and another knit fabric 102 (indicated by thin lines) of a back part 5 are shown in an overlapping condition, and a process of knitting the same will be described with reference to FIG. 5. However, description will be given only of a left-hand side portion of the garment (left-hand side front shoulder portion of the vest facing the same) for the convenience of description.

Figures 5A, 5B, 5C, 5D:
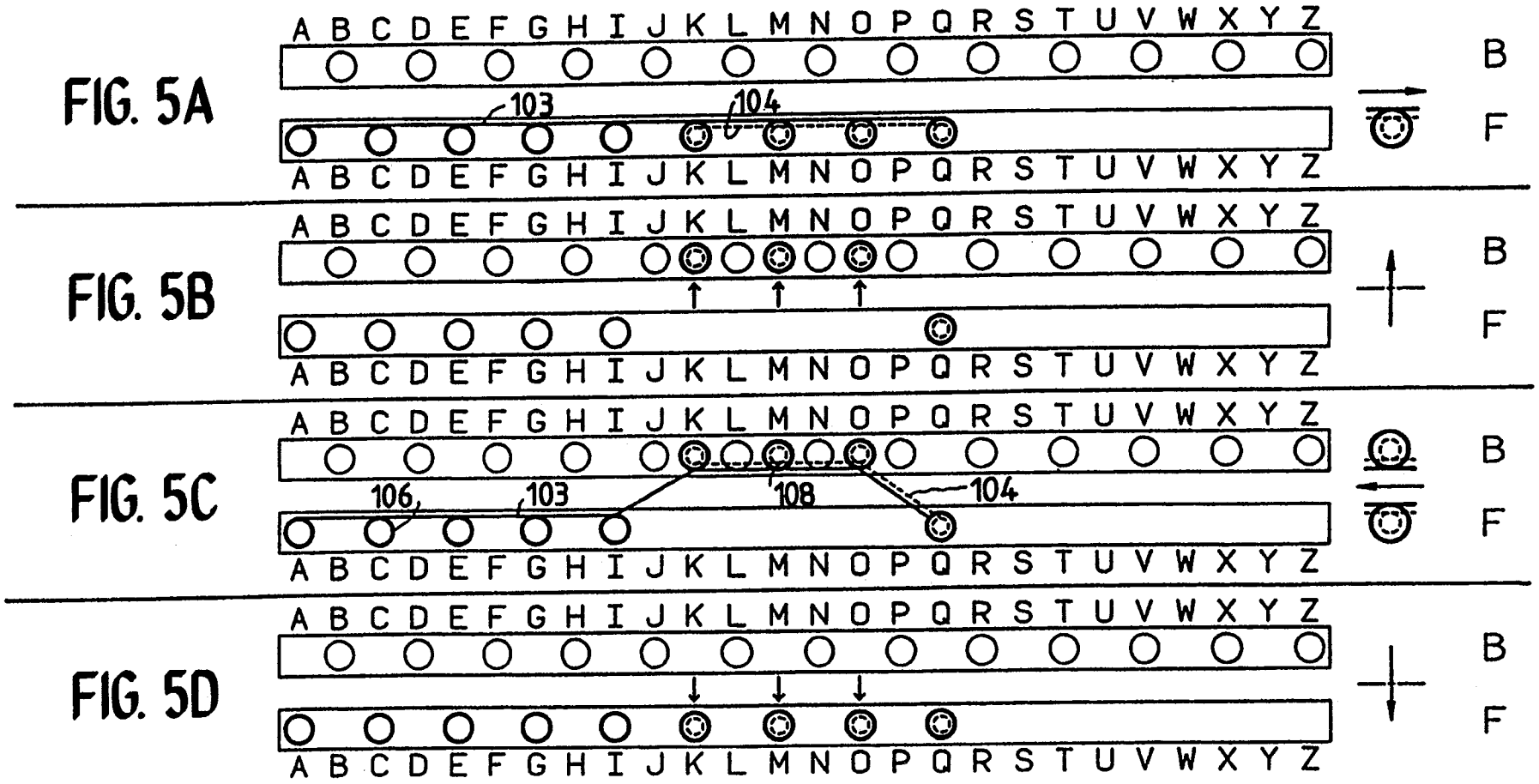
Figures 5E, 5F, 5G, 5H:
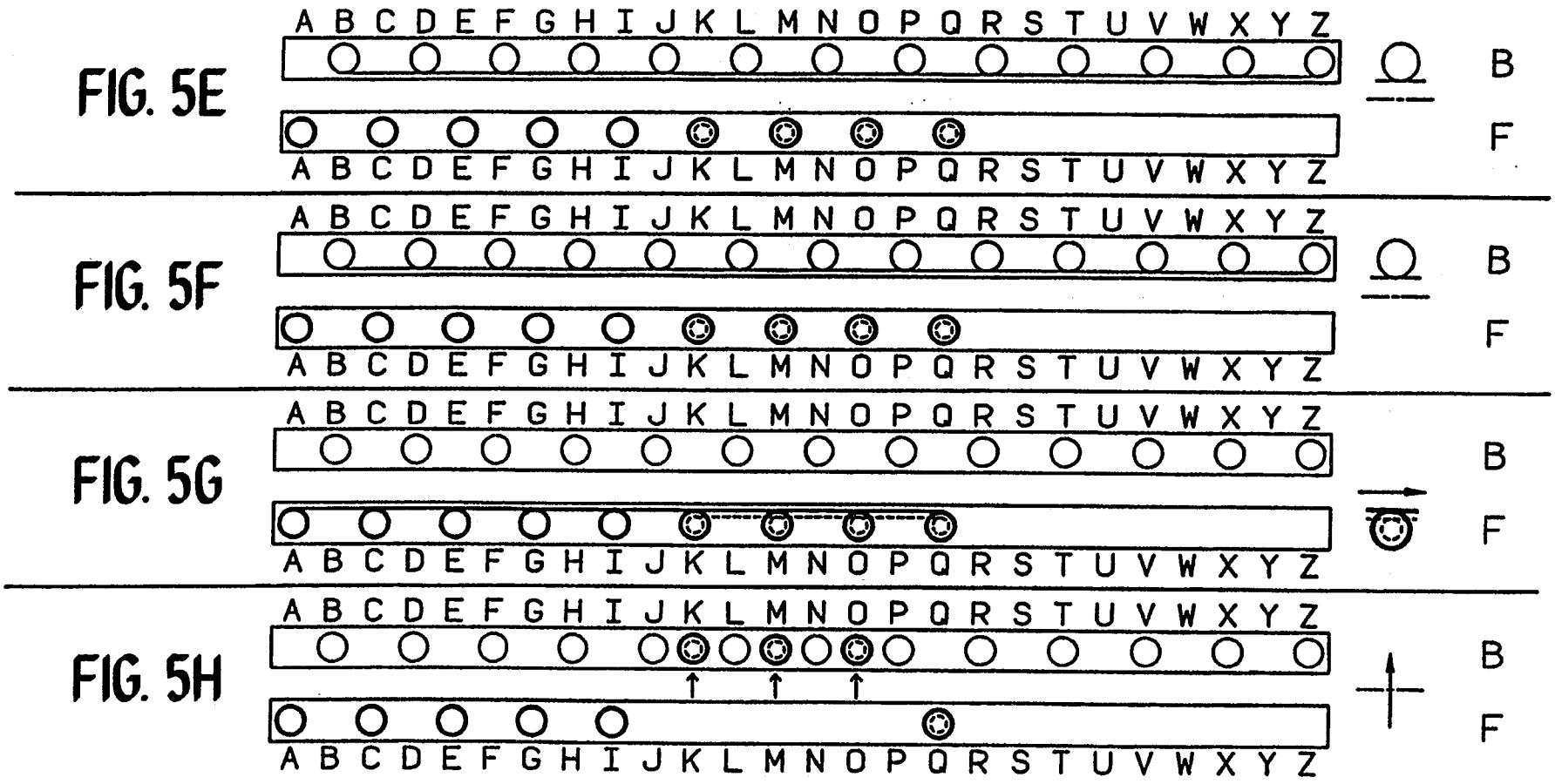
Figures 5I, 5J, 5K, 5L:
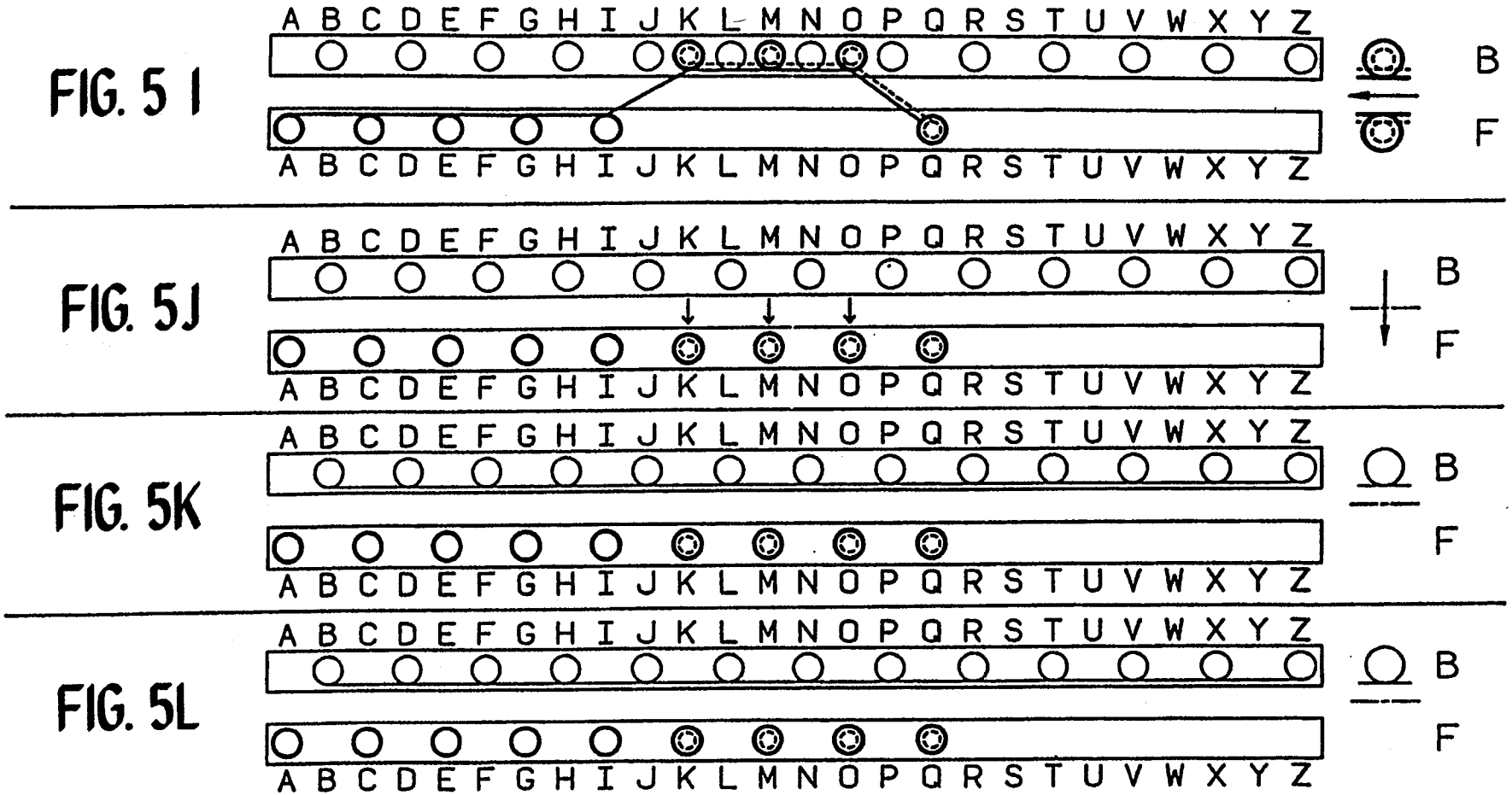

First, in a course I of the knit fabric (hereinafter referred to as front knit fabric) 101 of the left-hand side front shoulder portion 6, a ground yarn 103 is supplied to every other needles A, C . . . and Q of a front bed F while a plating yarn 104 is supplied separately to the needles K, M, O and Q in a properly arranged condition and knit as shown in FIG. 5A. And, in order to knit a knit fabric end edge portion 3 (shown in FIG. 1) into a purl stitch 105 wherein a knit loop and a purl loop appear alternately in a direction of a wale, loops 106 of the ground yarn 103 and plating yarn 104 on the needles K, M and 0 of the front bed F are transferred to needles K, M and 0 of a back bed B (FIG. 5B). And in a course II, the ground yarn 103 is supplied to and knit by the needles Q, I, . . . , C and A of the front bed F and the needles O, M and K of the back bed B while the plating yarn 103 is simultaneously supplied to and knit by the same needles Q, 0, M and K, and consequently, knit loops 107 are knit by the needles Q, I, . . . , C and A while purl loops 108 are knit by the needles O, M and K (FIG. 5C). Subsequently, in order to knit the knit fabric (hereinafter referred to as back knit fabric) 102 of the back part 5 on the back bed B, the loops suspended on the needles K, M and 0 of the back bed B are transferred to the needles K, M and 0 of the front bed F (FIG. 5D), and then a knitting yarn is supplied to B, C, . . . and Z of the back bed B to knit a course III (FIG. 5E). Then, also a succeeding course IV is knit similarly (FIG. 5F).

Subsequently, advancing to knitting of the front knit fabric 101 again, a yarn is supplied and knit similarly as described above to knit courses V and VI (FIGS. 5G to 5J), and then knitting of courses VII and VIII of the back knit fabric 12 (FIGS. 5K and 5L) is performed.

After completion of such knitting as described above, the position of the knit fabric end edge portion 3 must be displaced to the left in order to open an upper portion of the neck line portion 2 into a V shape. To this end, the knitting width of the front knit fabric 101 is to be reduced.

First, loops 109 on the needles E, G, . . . and Q of the front bed F of the course VI of the front knit fabric 101 are transferred to the needles E, G, . . . and Q of the back bed B (FIG. 5M). Then, the back bed B is racked by a distance equal to two needle distances in the leftward direction so that the needles A, B, . . . and X of the front bed F and the needles C, D, E, . . . and Z of the back bed B are opposed to each other (FIG. 5N). Then, the loops 109 having been transferred to the needles E, G, . . . and Q of the back bed B of the course VI are transferred back to the needles C, E, . . . and 0 of the front bed F. Consequently, the loops which were on the needles E, G, . . . Q of the front bed F of the front knit fabric 101 are moved to the adjacent needles C, E, . . . and 0 of the same front bed F leftwardly by the two needle distances such that the loop 109 which was on the needle E is overlapped with the loop 110 on the needle C (FIG. 5O).

After such loop transfer, knitting returns to FIG. 5A and is repeated, and each time racking is performed, loops are displaced so that the neck line portion 2 is widened.

According to such knitting as described above, at the knit fabric end edge portion 3 along the neck line portion 2, a purl stitch portion 105 is formed over four wales, and a fashion mark 111 of knit loops by racking appears over three wales on the inner side of the four wales and constitutes a profile of the knit fabric end edge portion 3 of the neck line portion 2. In addition, since the ground yarn 101 and the plating yarn 104 are knit in a properly arranged condition over the four wales in the example shown of the knit fabric end edge portion 3 of the neck line portion 2. Accordingly, the plated portion has a greater thickness than the other portion which is knit only with the ground yarn thereby to present the neck line portion clearly and is effective to fashioning, reinforcement and so forth of an end portion.

While the two examples described above are described in connection with steps in the case of knitting on a knitting machine of the two-bed type, a knit fabric can be knit similarly on a knitting machine of the four-bed type.

Figures 6A, 6B, 6C:
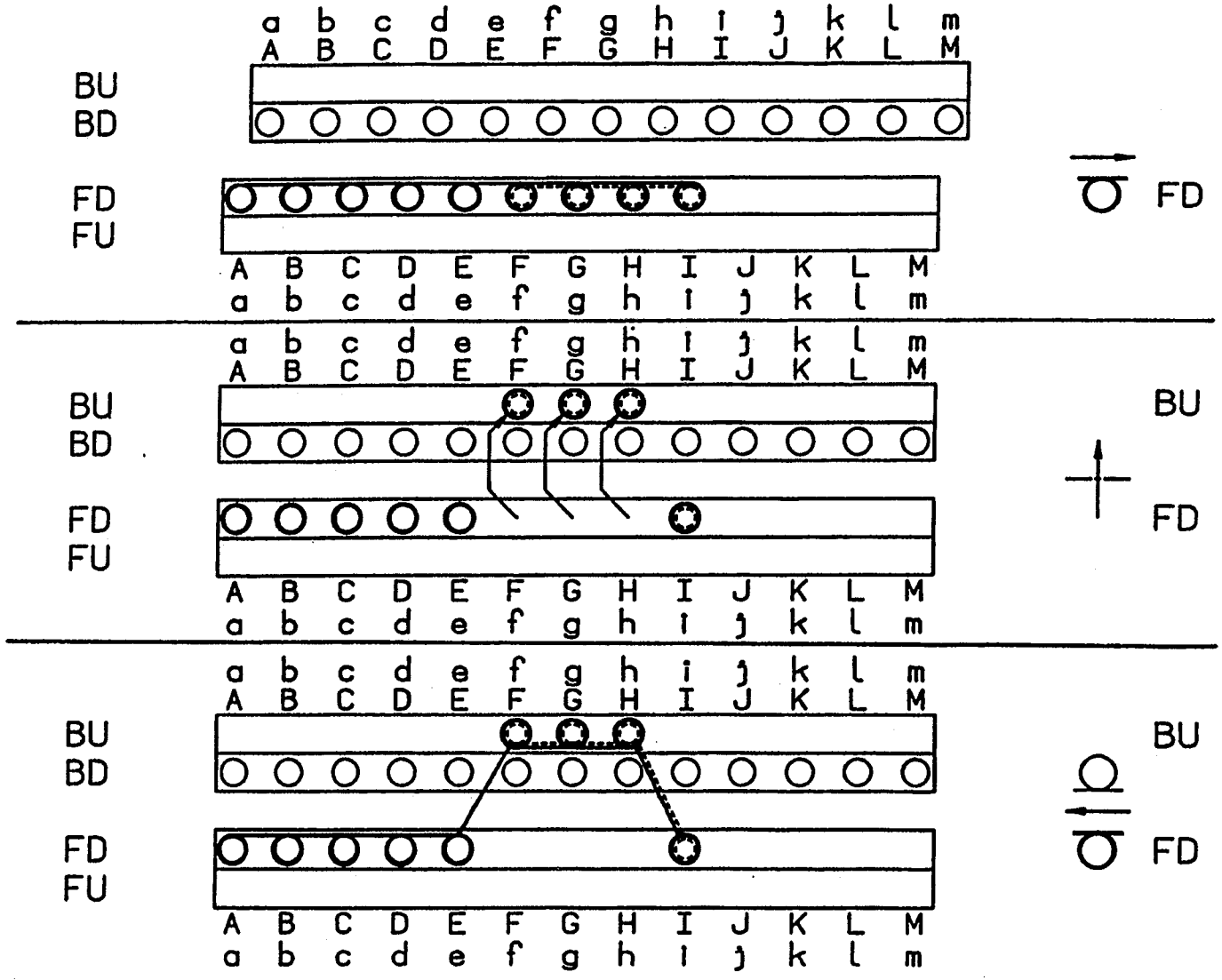
FIGS. 6A to 6O are knitting diagrams showing supply yarns and loops of a knit fabric suspended on needles of front and back needle beds in the order of steps when a knit fabric wherein plating is performed only for an end portion is to be knit on a knitting machine of the four bed type.
Figures 6D, 6E, 6F:
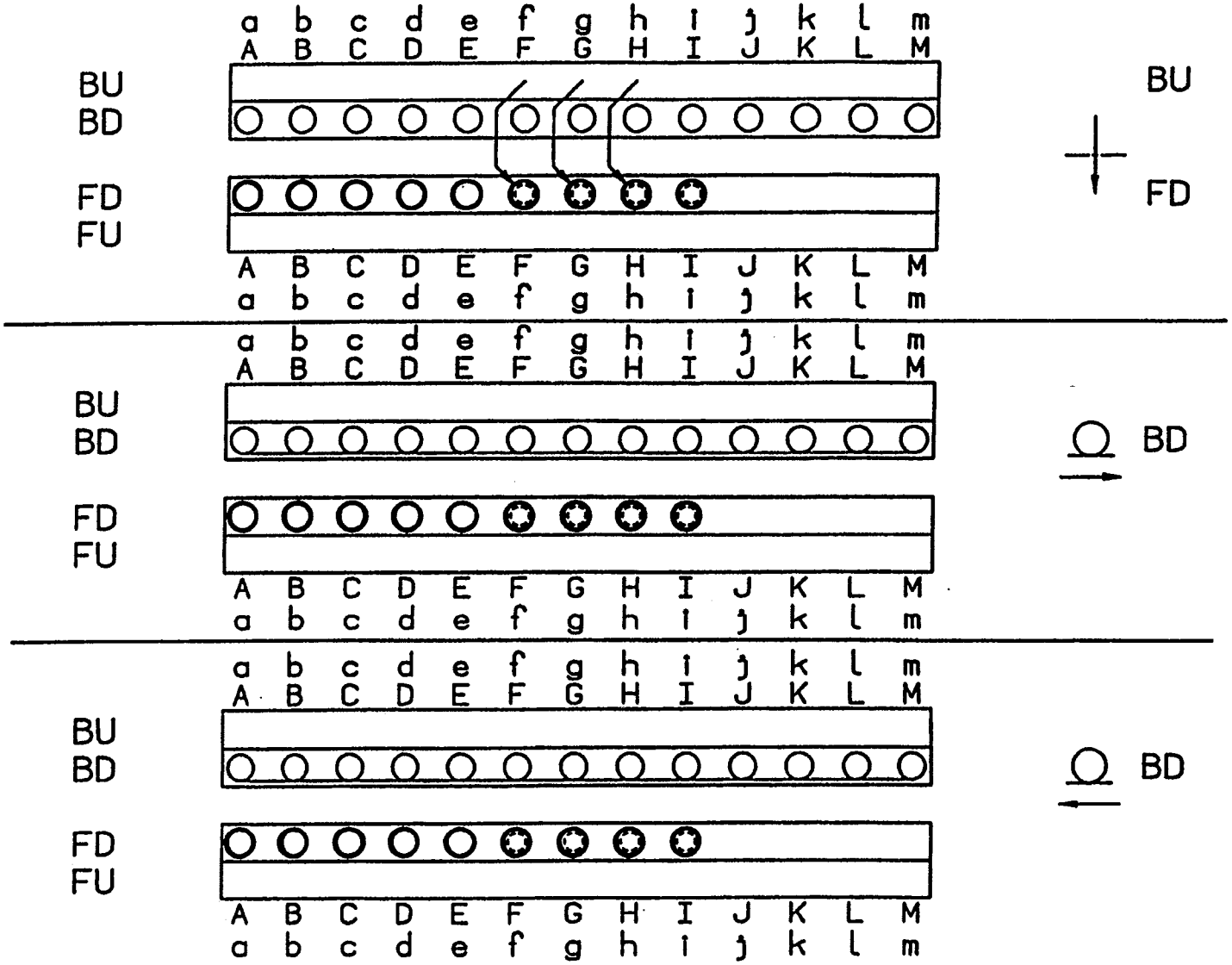
Figures 6G, 6H, 6I:
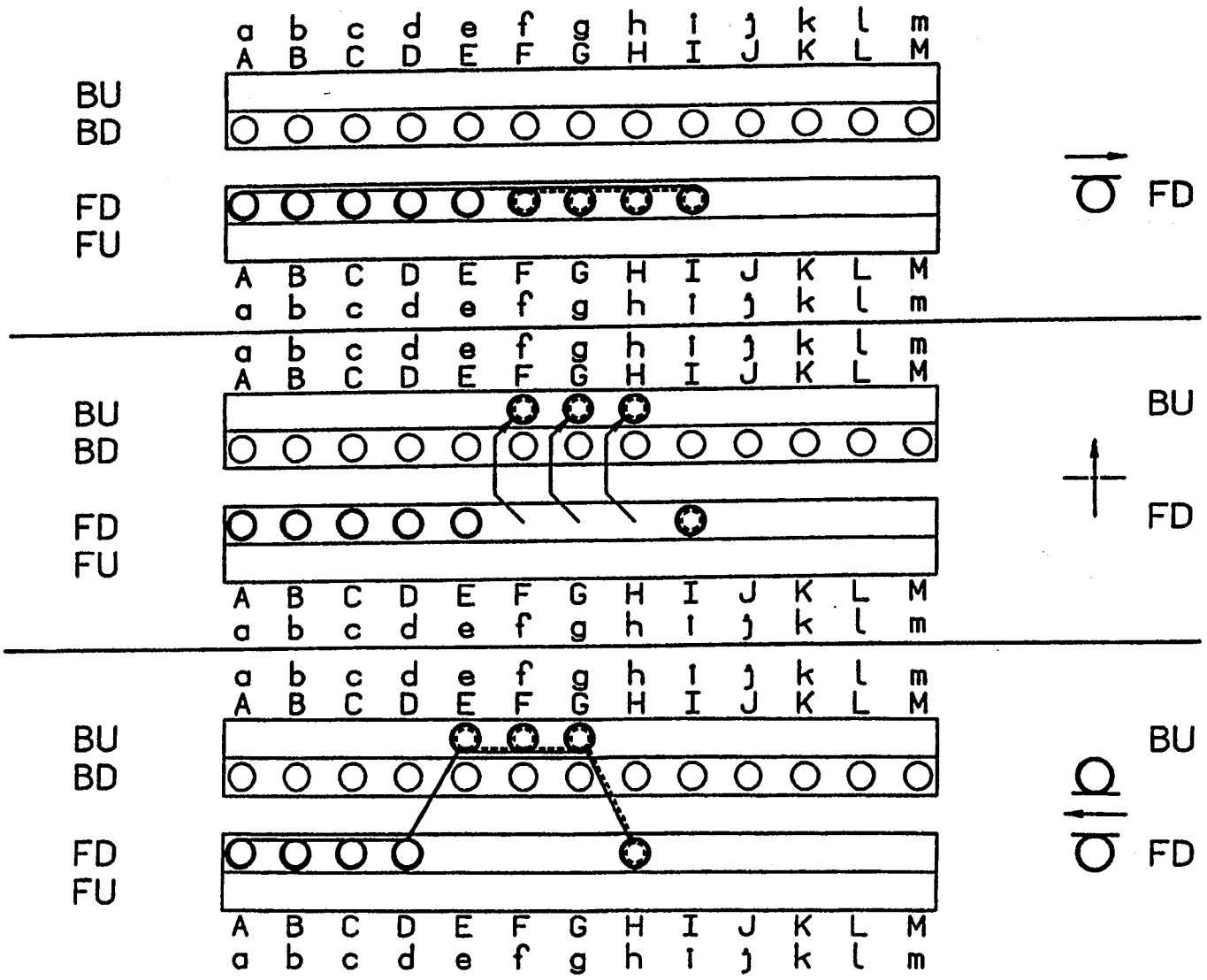
Figures 6J, 6K, 6L:
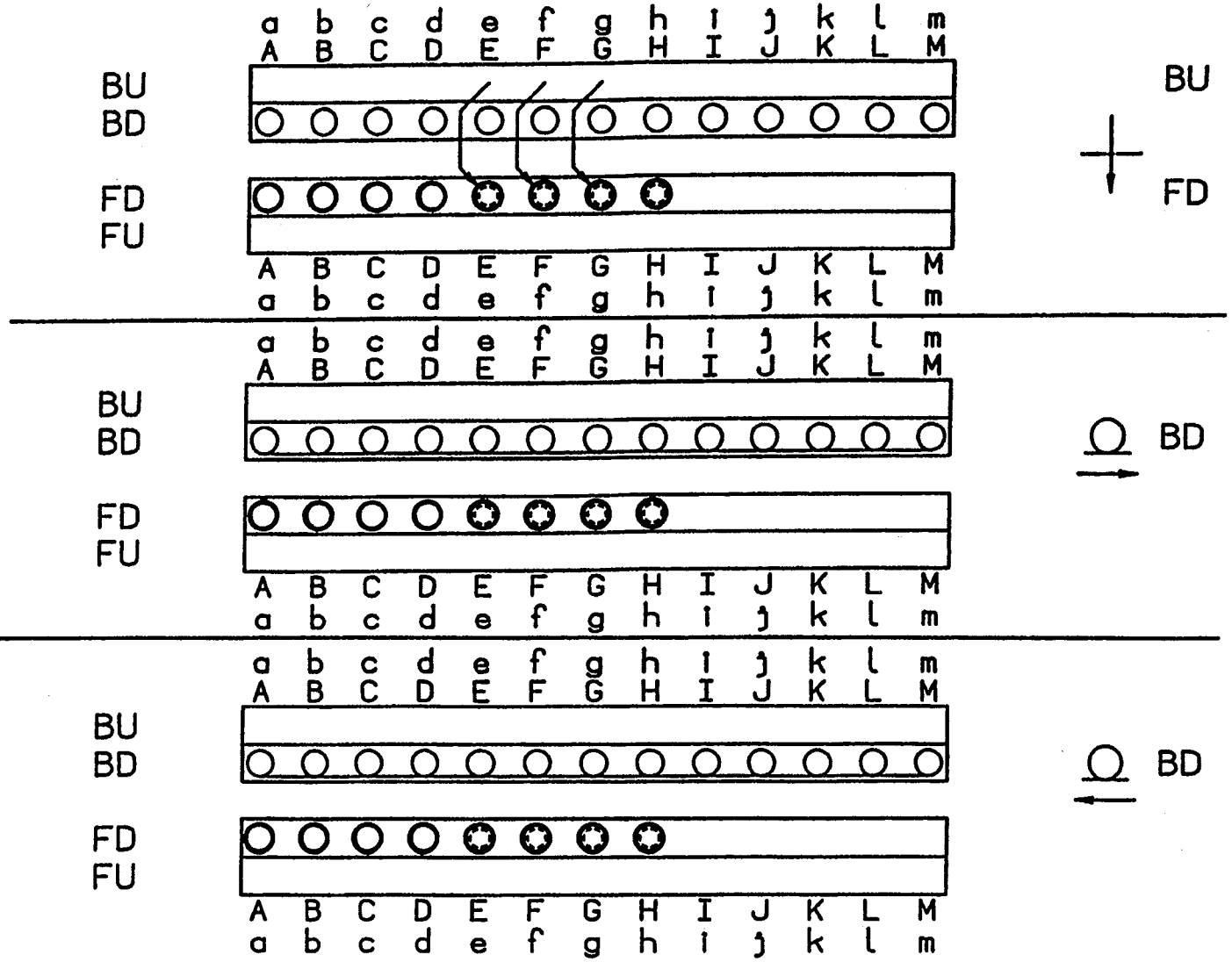
Figures 6M, 6N, 6O:
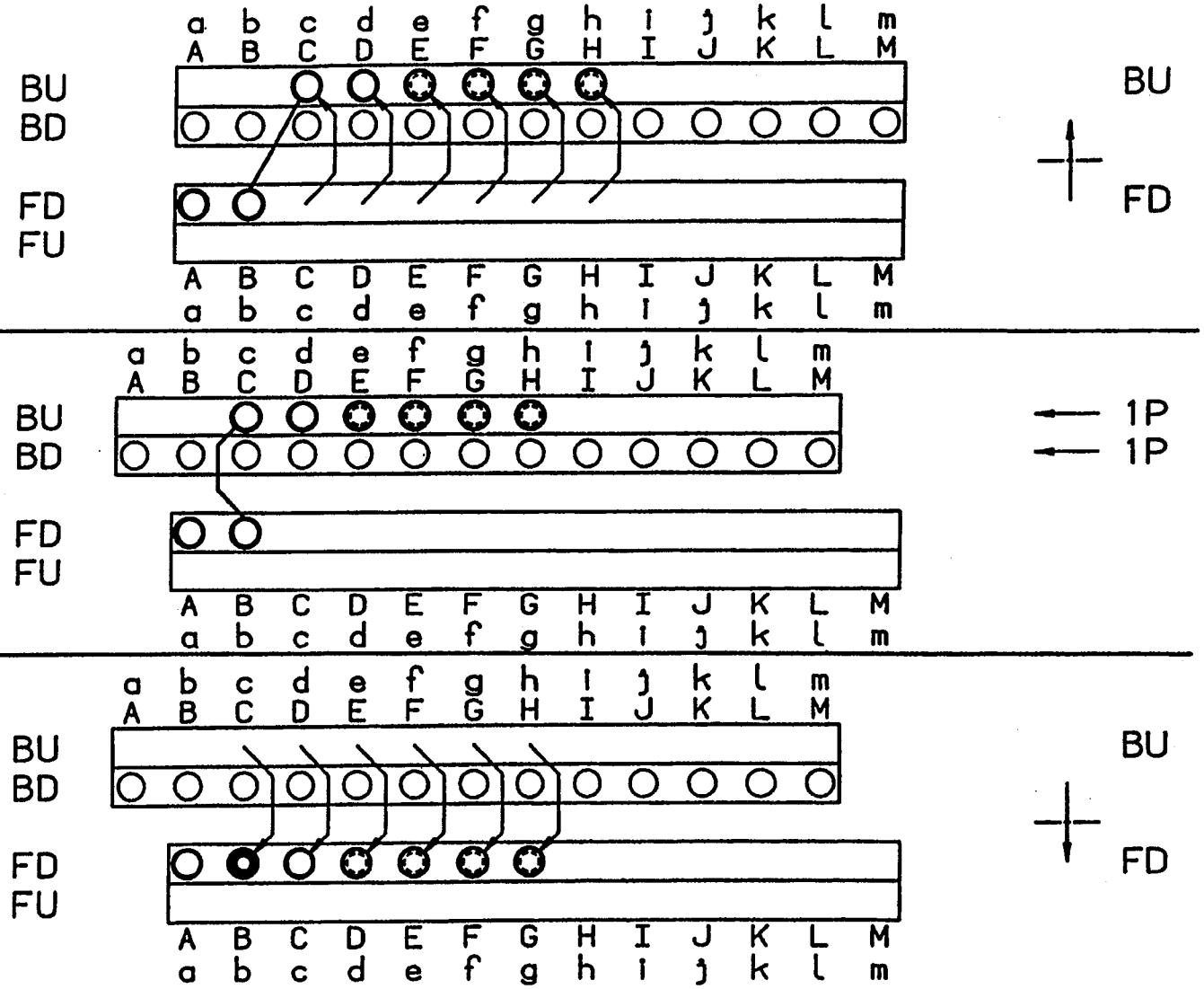

Yarn supplying conditions when a plating yarn is knit in knitting of an end portion are shown in the order of steps in FIGS. 6A to 6O. In the drawings, reference character BU denotes an upper back bed, BD a lower back bed, FU an upper front bed, and FD a lower front bed.

Figure 7:
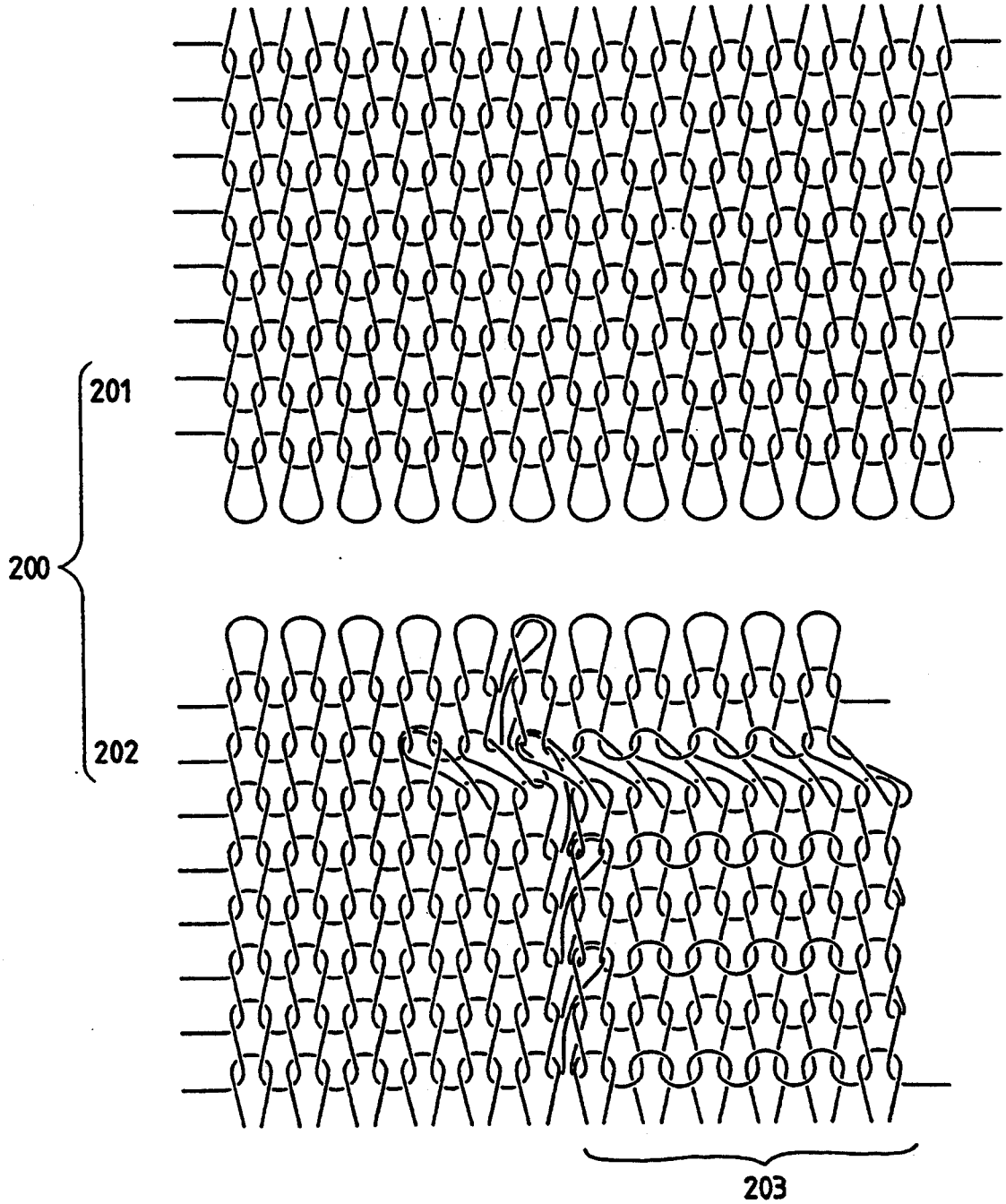
FIG. 7 is a structural view in a condition wherein both front and back side knit fabrics of a tubular knit fabric of an intersia stitch of the present invention are opened upwardly and downwardly with respect to the center.

An example of a knit fabric 200 of an intersia stitch is shown in FIG. 7. FIG. 7 shows a knit fabric of front part 202 and a knit fabric of back part 201 in an upwardly and downwardly developed condition with respect to the center, and 6 right-hand side wales of the knit fabric of front part constitute a collar portion 203 and are displaced leftwardly by one pitch for each suitable number of courses so as to constitute a V shape of the collar. The collar portion 203 is knit in a purl stitch so that no curling may take place on the knit fabric of the collar portion 203.

Figures 8A, 8B, 8C, 8D:
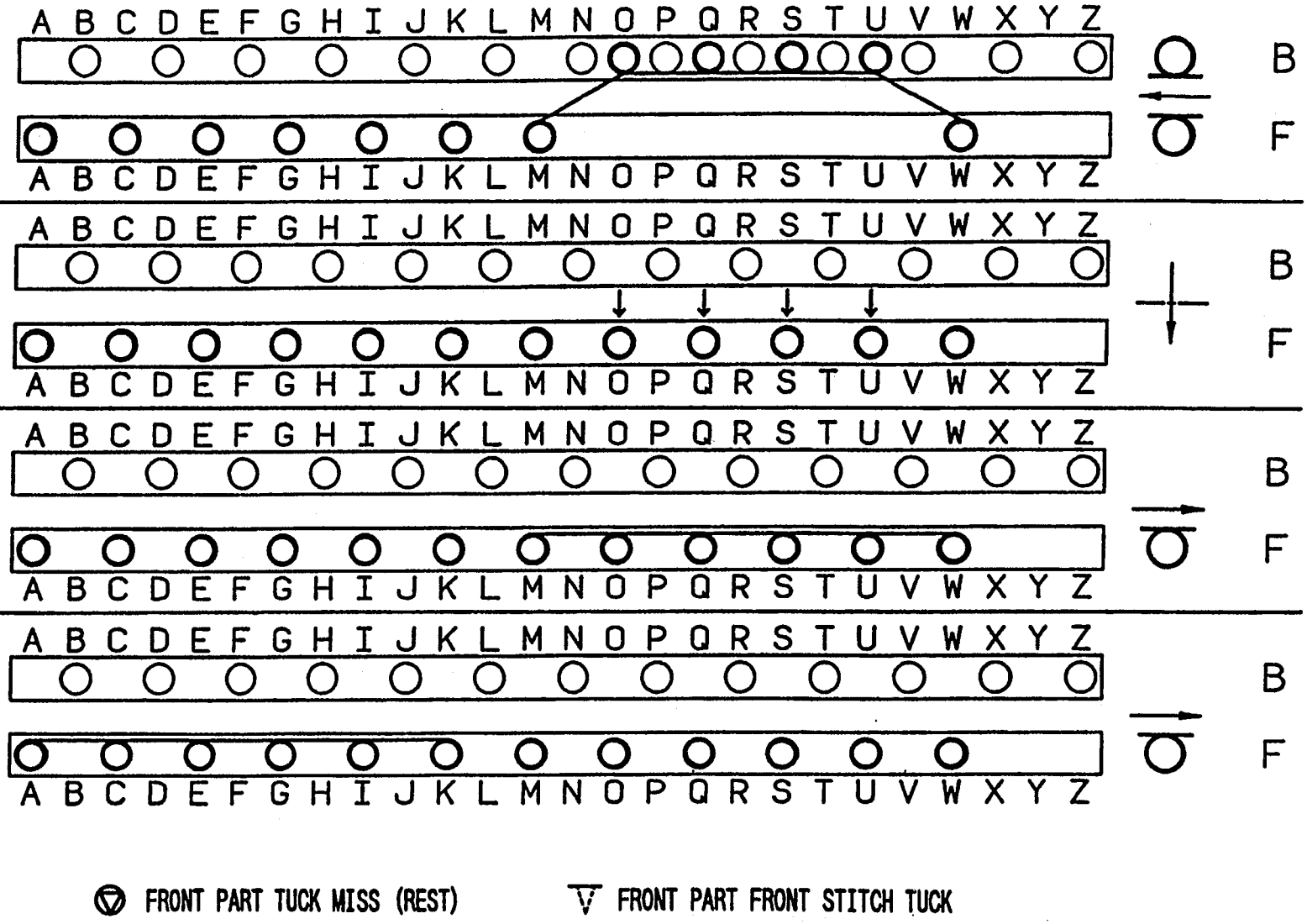
FIGS. 8A to 8BB are knitting diagrams showing conditions of a supply yarn and loops of a knit fabric suspended on needles of front and back needle beds in the order of steps when such knit fabric as shown in FIG. 7 is to be knit on a knitting machine of the two-bed type.
Figures 8E, 8F, 8G, 8H, 8I:
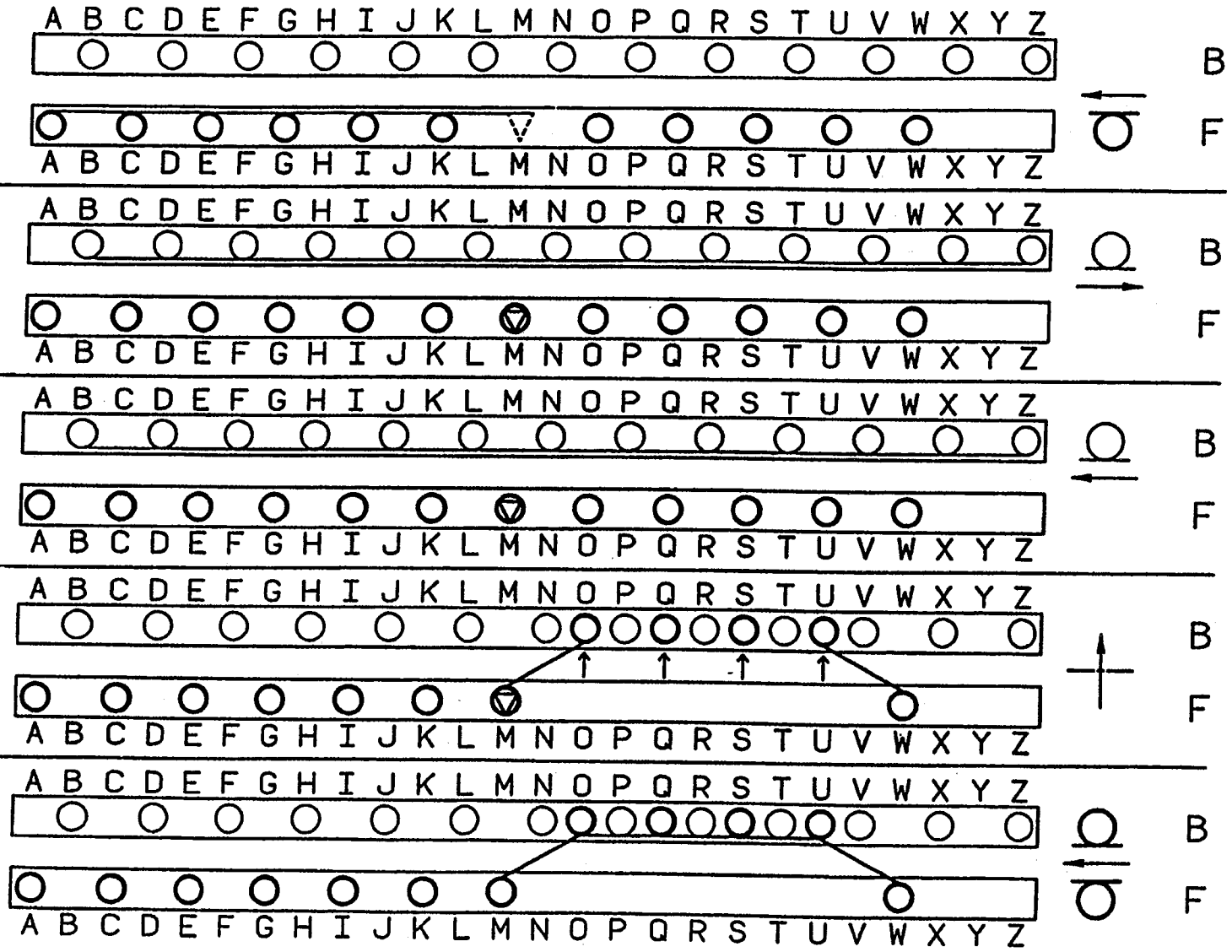
Figures 8J, 8K, 8L, 8M, 8N:
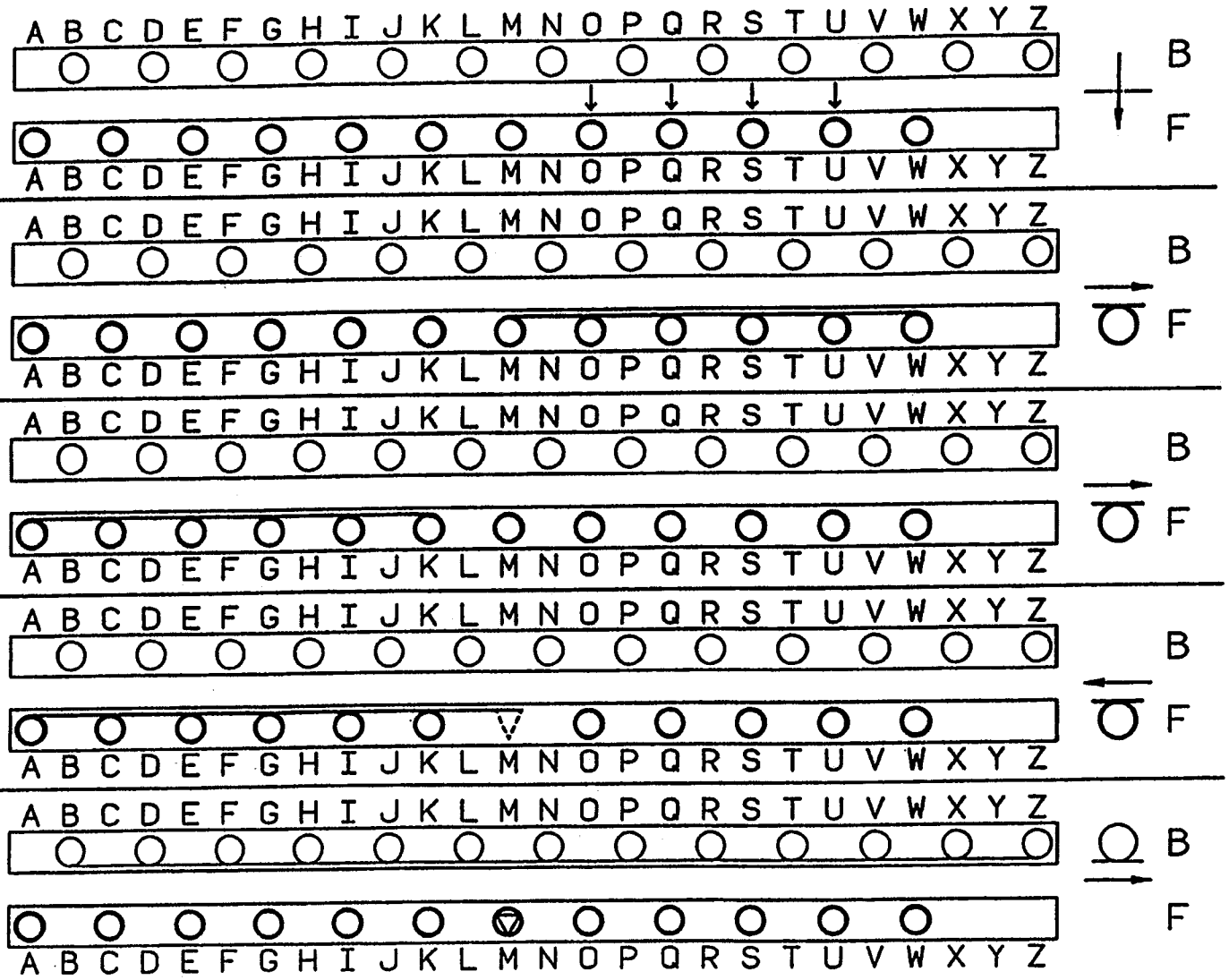
Figures 8O, 8P, 8Q, 8R, 8S:
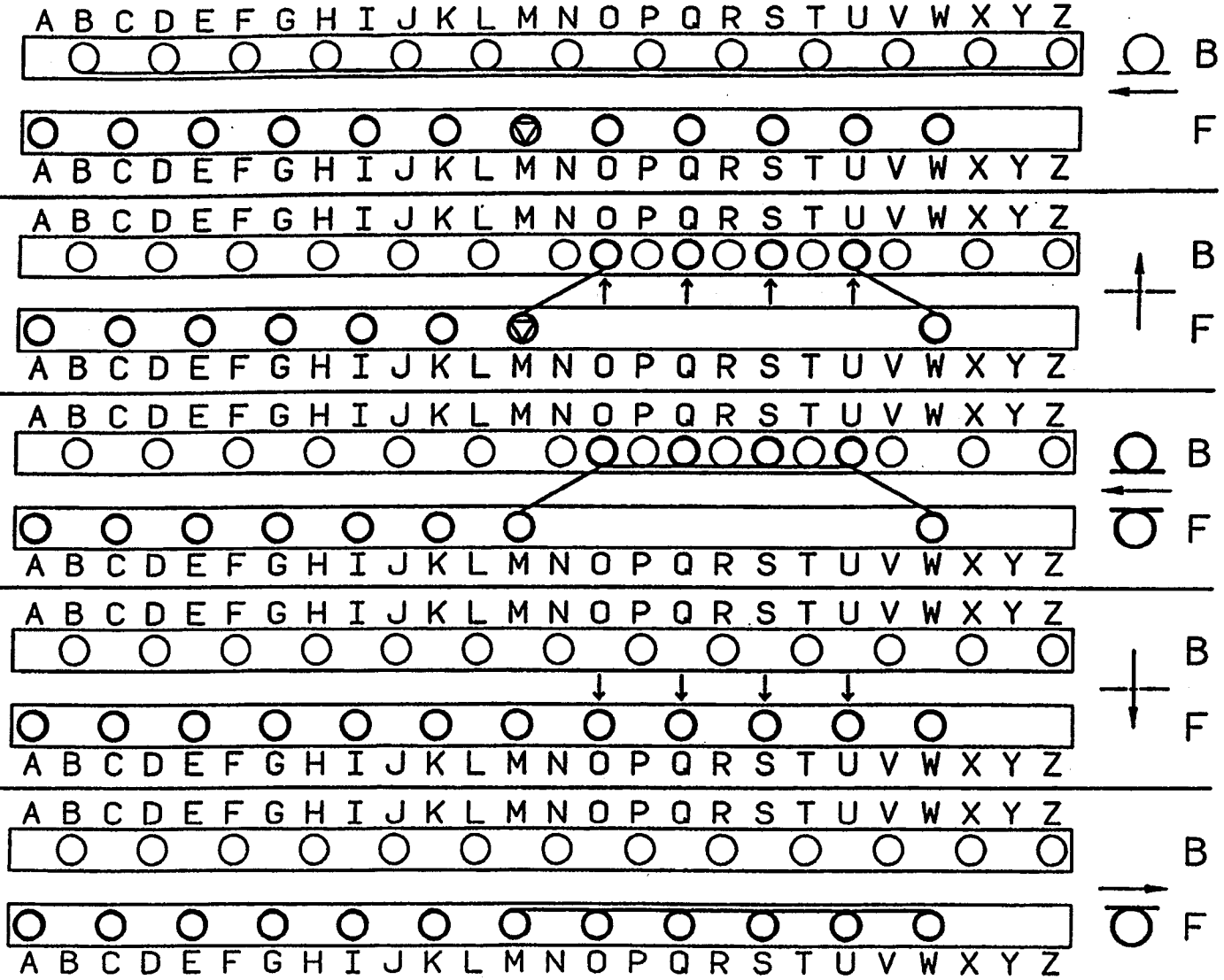
Figures 8T, 8U, 8V, 8W, 8X:
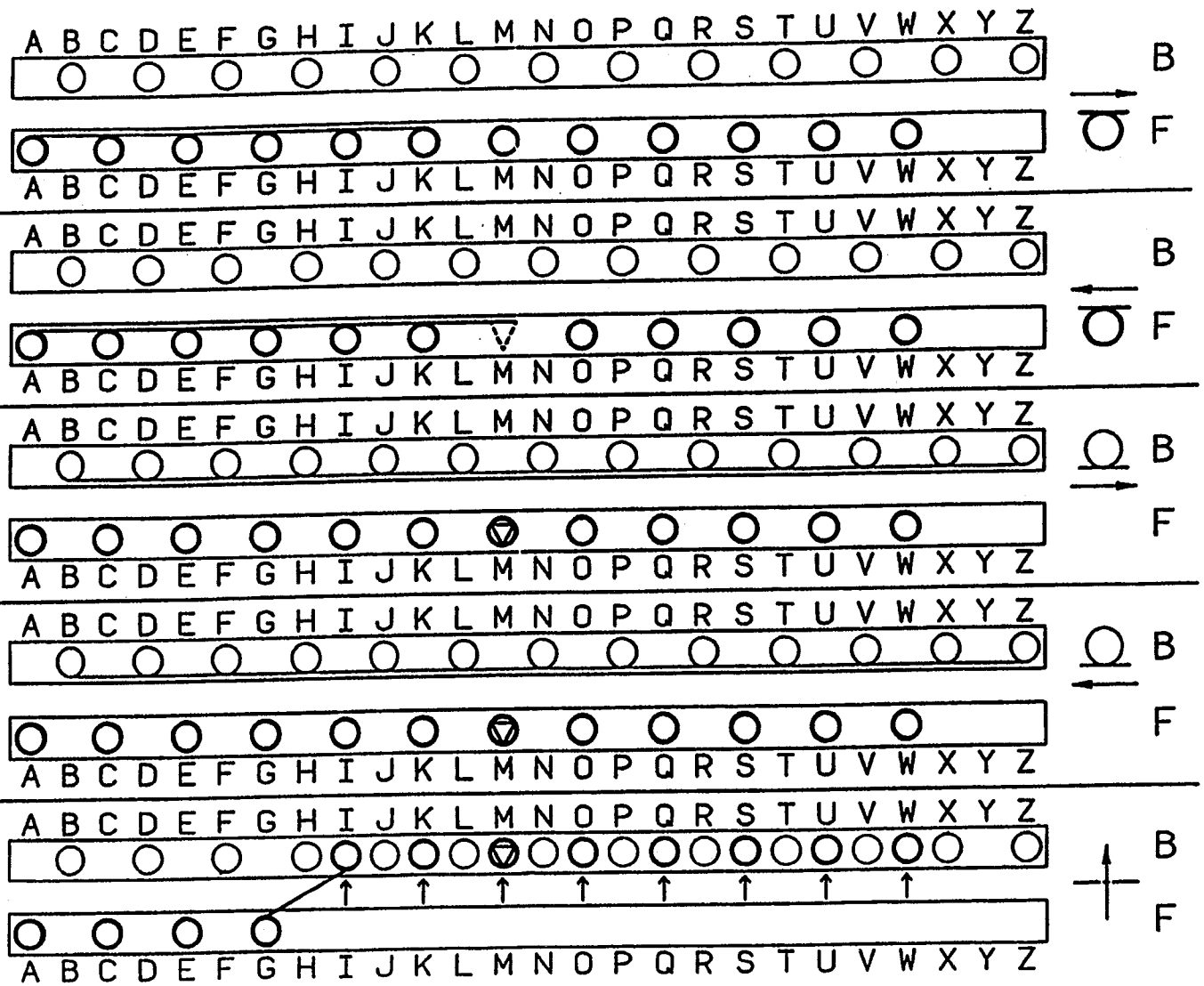
Figures 8A, 8B, 8Y, 8Z:
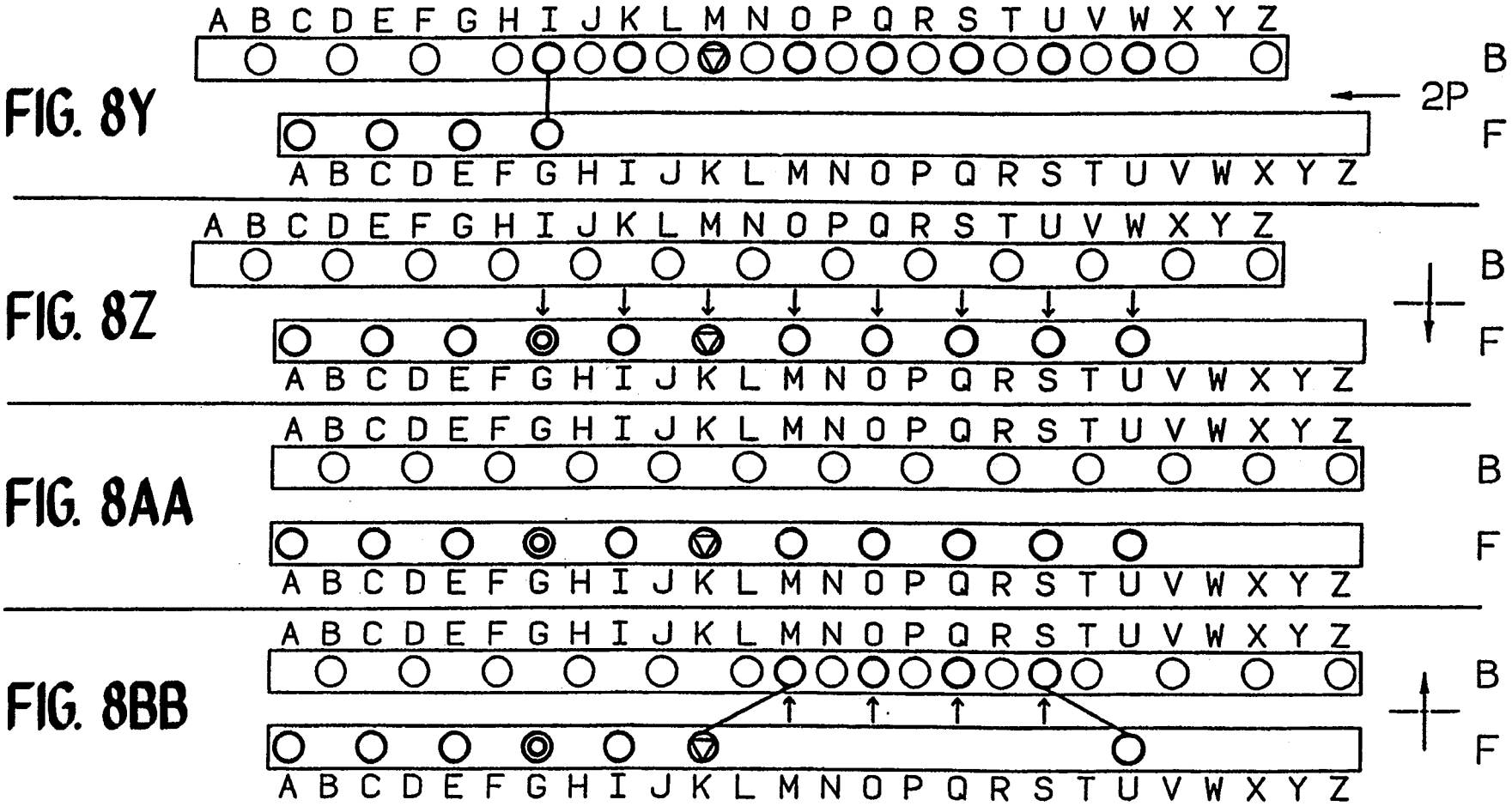

Conditions of a supply yarn and loops of a knit fabric suspended on needles of front and back needle beds when such knit fabric as shown in FIG. 7 is to be knit on a knitting machine of the two-bed type are shown in knitting diagrams in the order of steps in FIGS. 8A to 8Y.

Industrial Applicability

Since a knit fabric of the present invention is constituted such that, at an end edge of a vent opening portion such as a neck line or an armhole provided on a knit fabric knit in a tubular configuration, a knit structure for shaping, reinforcement or the like of the end portion is formed simultaneously upon knitting of the knit fabric, there is not need of performing a sewing operation for the end portion after knitting, and accordingly, the production cost can be reduced.

Further, since the knitting process described above is adopted for an end portion, the knit fabric is not worn out of shape readily and can maintain a shape keeping property, and besides can obtain an additional value in regard to the fashion.

I claim:

1. In a flat knitting machine having a front needle bed and a back needle bed for forming a tubular knit fabric by changing the needle bed to which a yarn is fed and by changing the feeding direction of a knitting yarn at an end portion of a knitting range on the needle bed, a method of forming a vent portion in the tubular knit fabric as a plurality of wales at an edge of the vent portion are knitted, the method comprising the steps of:

(1) knitting a cylindrical fabric on alternating needles in courses prior to formation of the vent portion;

(2) forming the progressive opening vent portion by the steps of;

(a) transferring loops from needles of a plurality of wales arranged along a section where the vent portion is to be formed from the front needle bed to corresponding empty needles of the back, opposing needle bed;

(b) supplying yam to and knitting on needles of the front needle bed maintaining loops and on the back needle bed on the corresponding needles;

(c) transferring loops from the corresponding needles on the back needle bed to the front needle bed;

(d) knitting a course on the front and the back needle beds;

(e) repeating steps (a), (b) and (c);

(f) transferring loops from at least a first, second and third wale from the front needle bed to the corresponding empty needles on the back needle bed;

(g) racking the back needle bed at least two needle positions in a direction to a side opposite the vent portion;

(h) transferring the loops from the back needle bed to the front needle bed; and (i) repeating steps (a)–(h) to form the vent portion.

2. The method of claim 1, comprising the step of knitting at least one of a purl pattern or a links pattern in the direction of a course in which a plurality of wales of knit loops or purl loops are disposed at an end edge portion of the fabric along the vent portion to thereby reduce curling and improve reinforcement.

3. The method of claim 1, comprising the step of disposing a plurality of wales of knit loops and a plurality of wales of purl loops alternately at an end edge portion of the fabric along the vent portion to knit a rib stitch to thereby reduce curling and improve reinforcement.

4. The method of claim 1, comprising the step of supplying a plating yarn together with a ground yarn to at least one of the wales of an end edge portion of the knit fabric along the vent portion to thereby reinforce the end edge portion and reduce curling.

* * * * *